US011083356B2

(12) United States Patent
Koura

(10) Patent No.: US 11,083,356 B2
(45) Date of Patent: Aug. 10, 2021

(54) ROBOTIC DUST COLLECTOR AND SELF-PROPELLED DEVICE

(71) Applicant: MAKITA CORPORATION, Anjo (JP)

(72) Inventor: Kentaro Koura, Anjo (JP)

(73) Assignee: MAKITA CORPORATION, Anjo (JP)

( * ) Notice: Subject to any disclaimer, the term of this patent is extended or adjusted under 35 U.S.C. 154(b) by 240 days.

(21) Appl. No.: 16/103,208

(22) Filed: Aug. 14, 2018

(65) Prior Publication Data

US 2019/0059674 A1 Feb. 28, 2019

(30) Foreign Application Priority Data

Aug. 31, 2017 (JP) ..... JP2017-167545

(51) Int. Cl.
*A47L 9/28* (2006.01)
*A47L 9/00* (2006.01)
*A47L 9/16* (2006.01)

(52) U.S. Cl.
CPC ..... *A47L 9/2831* (2013.01); *A47L 9/009* (2013.01); *A47L 9/2815* (2013.01);
(Continued)

(58) Field of Classification Search
CPC ..... A47L 2201/00; A47L 2201/04; A47L 2201/06; A47L 9/009; A47L 9/1683;
(Continued)

(56) References Cited

U.S. PATENT DOCUMENTS

2013/0061416 A1* 3/2013 Dyson ..... B60L 50/52 15/319
2013/0340201 A1* 12/2013 Jang ..... A47L 9/009 15/319

(Continued)

FOREIGN PATENT DOCUMENTS

CN 204971112 U 1/2016
CN 105326442 A 2/2016

(Continued)

OTHER PUBLICATIONS

JP 2015093129 A—English Machine Translation (Year: 2015).*

(Continued)

*Primary Examiner* — Marc Carlson
(74) *Attorney, Agent, or Firm* — Oliff PLC

(57) ABSTRACT

A robotic dust collector includes a body, a wheel, a wheel motor, and a suspension device. The body accommodates a storage unit to store therein dust and dirt sucked in from a suction inlet. The wheel supports the body. The wheel motor generates motive power to rotate the wheel. The suspension device includes a support member, a motive-force generating mechanism, and an adjustment mechanism. The wheel is supported rotatably about a center axis by the support member. The motive-force generating mechanism gives a motive force to the support member to generate a biasing force to cause the wheel to protrude from a bottom face of the body. The adjustment mechanism adjusts the biasing force based on a protrusion amount of the wheel from the bottom face. The suspension device gives the biasing force adjusted by the adjustment mechanism to the wheel.

13 Claims, 6 Drawing Sheets

(52) U.S. Cl.
CPC ..... *A47L 9/2842* (2013.01); *A47L 9/2852* (2013.01); *A47L 9/1683* (2013.01); *A47L 2201/00* (2013.01); *A47L 2201/04* (2013.01); *A47L 2201/06* (2013.01)

(58) Field of Classification Search
CPC .... A47L 9/2815; A47L 9/2831; A47L 9/2842; A47L 9/2852
See application file for complete search history.

(56) References Cited

U.S. PATENT DOCUMENTS

| | | | | |
|---|---|---|---|---|
| 2014/0145495 | A1* | 5/2014 | Shin | B25J 5/007 301/6.5 |
| 2016/0000282 | A1* | 1/2016 | Vanderstegen-Drake | A47L 9/009 280/6.157 |
| 2016/0007817 | A1* | 1/2016 | Schlischka | A47L 11/4061 280/5.514 |
| 2016/0015232 | A1 | 1/2016 | Nakamura et al. | |

FOREIGN PATENT DOCUMENTS

| | | | | |
|---|---|---|---|---|
| CN | 106142045 | A | | 11/2016 |
| CN | 106659342 | A | | 5/2017 |
| JP | 2014176509 | A | * | 9/2014 |
| JP | 2015093129 | A | * | 5/2015 |
| JP | 2016-016321 | A | | 2/2016 |
| JP | 2016-073396 | A | | 5/2016 |
| JP | 2016-123819 | A | | 7/2016 |
| JP | 2017-113078 | A | | 6/2017 |
| JP | 2017221594 | A | * | 12/2017 |

OTHER PUBLICATIONS

JP-2017221594-A—English Machine Translation (Year: 2017).*
Jan. 5, 2021 Office Action in Chinese Patent Application No. 201810750185.6.
Mar. 22, 2021 Office Action issued in Japanese Patent Application No. 2017-167545.

* cited by examiner

ROBOTIC DUST COLLECTOR AND SELF-PROPELLED DEVICE

CROSS-REFERENCE TO RELATED APPLICATION(S)

The present application claims priority to and incorporates by reference the entire contents of Japanese Patent Application No. 2017-167545 filed in Japan on Aug. 31, 2017.

BACKGROUND OF THE INVENTION

1. Field of the Invention

The present invention relates to a robotic dust collector and a self-propelled device.

2. Description of the Related Art

Self-propelled devices, such as a robotic dust collector, a robotic lawn mower, a robotic dirt scraper, and a robotic truck, have been known. Japanese Patent Application Laid-open No. 2016-073396 discloses an example of a robotic dust collector (a self-propelled dust collecting robot). The self-propelled devices rotate wheels by the operation of a wheel motor, thereby propelling themselves on a work target surface.

Wheels are supported by a suspension device. The suspension device generates a biasing force to press the wheels against a work target surface. If the biasing force is not appropriate, then a self-propelled device possibly has a difficulty in stably propelling itself. For example, if the biasing force is excessively large, then a body of the self-propelled device supported by the wheels is floated up from the work target surface. As a result, the self-propelled device has a difficulty in stably propelling itself. In contrast, if the biasing force is excessively small, then the wheels are more likely to slip when the wheels are running up onto a step of the work target surface.

SUMMARY OF THE INVENTION

An object of an aspect of the present invention is to provide a robotic dust collector and a self-propelled device that are capable of stably propelling themselves.

According to a first aspect of the present invention, a robotic dust collector includes a body, a wheel, a wheel motor, and a suspension device. The body accommodates a storage unit to store therein dust and dirt sucked in from a suction inlet. The wheel supports the body. The wheel motor generates motive power to rotate the wheel. The suspension device includes a support member, a motive-force generating mechanism, and an adjustment mechanism. The wheel is supported rotatably about a center axis by the support member. The motive-force generating mechanism gives a motive force to the support member to generate a biasing force to cause the wheel to protrude from a bottom face of the body. The adjustment mechanism adjusts the biasing force based on a protrusion amount of the wheel from the bottom face. The suspension device gives the biasing force adjusted by the adjustment mechanism to the wheel.

According to a second aspect of the present invention, a self-propelled device includes a body; a wheel that supports the body; a wheel motor that generates motive power to rotate the wheel; a support member that supports the wheel and the wheel motor; and a spring having one end coupled to the body and another end guided by a guide provided in the support member.

DETAILED DESCRIPTION OF THE PREFERRED EMBODIMENTS

Robotic Dust Collector

Figure 1:
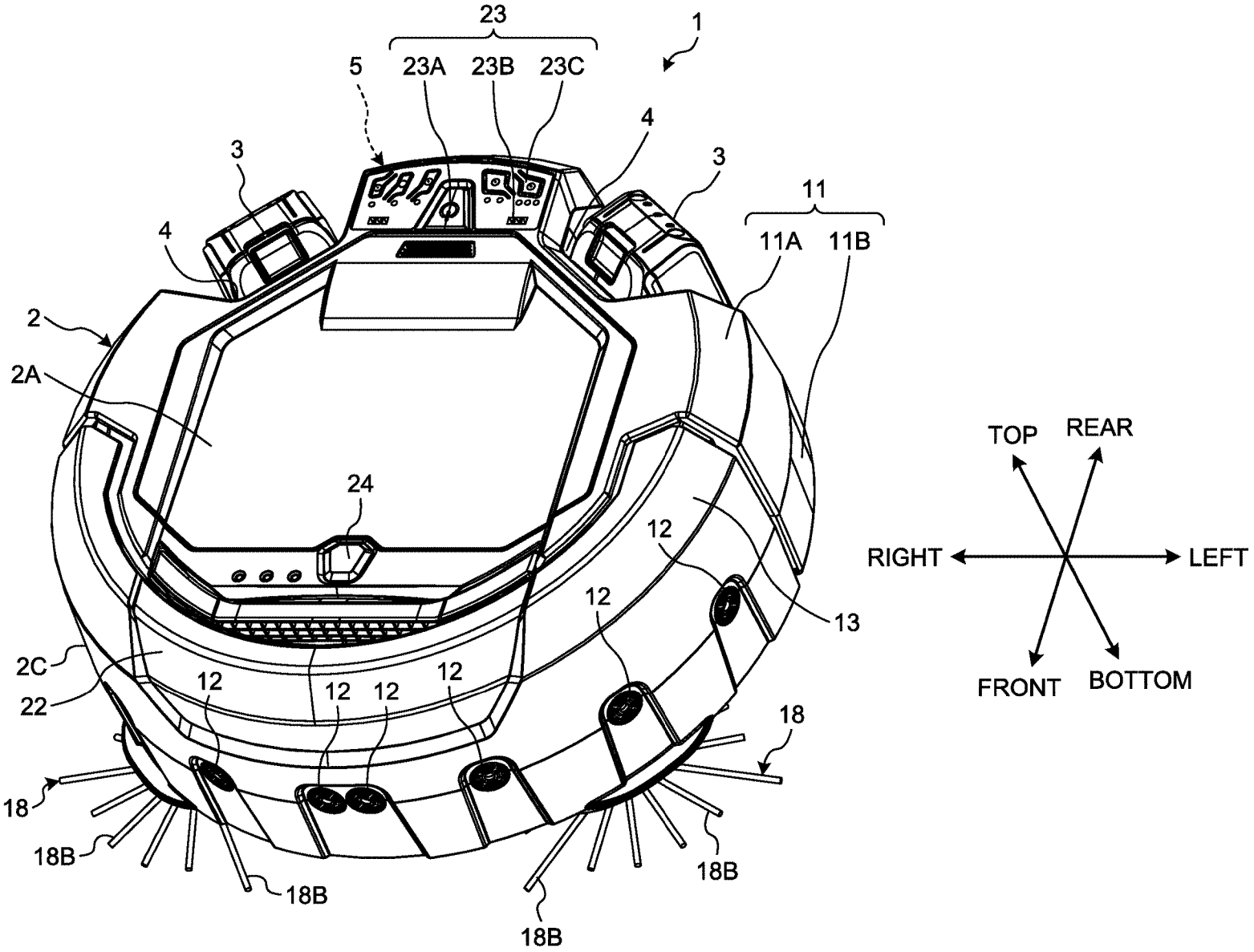
FIG. 1 is a perspective view of an example of a self-propelled device according to an embodiment.
Figure 2:
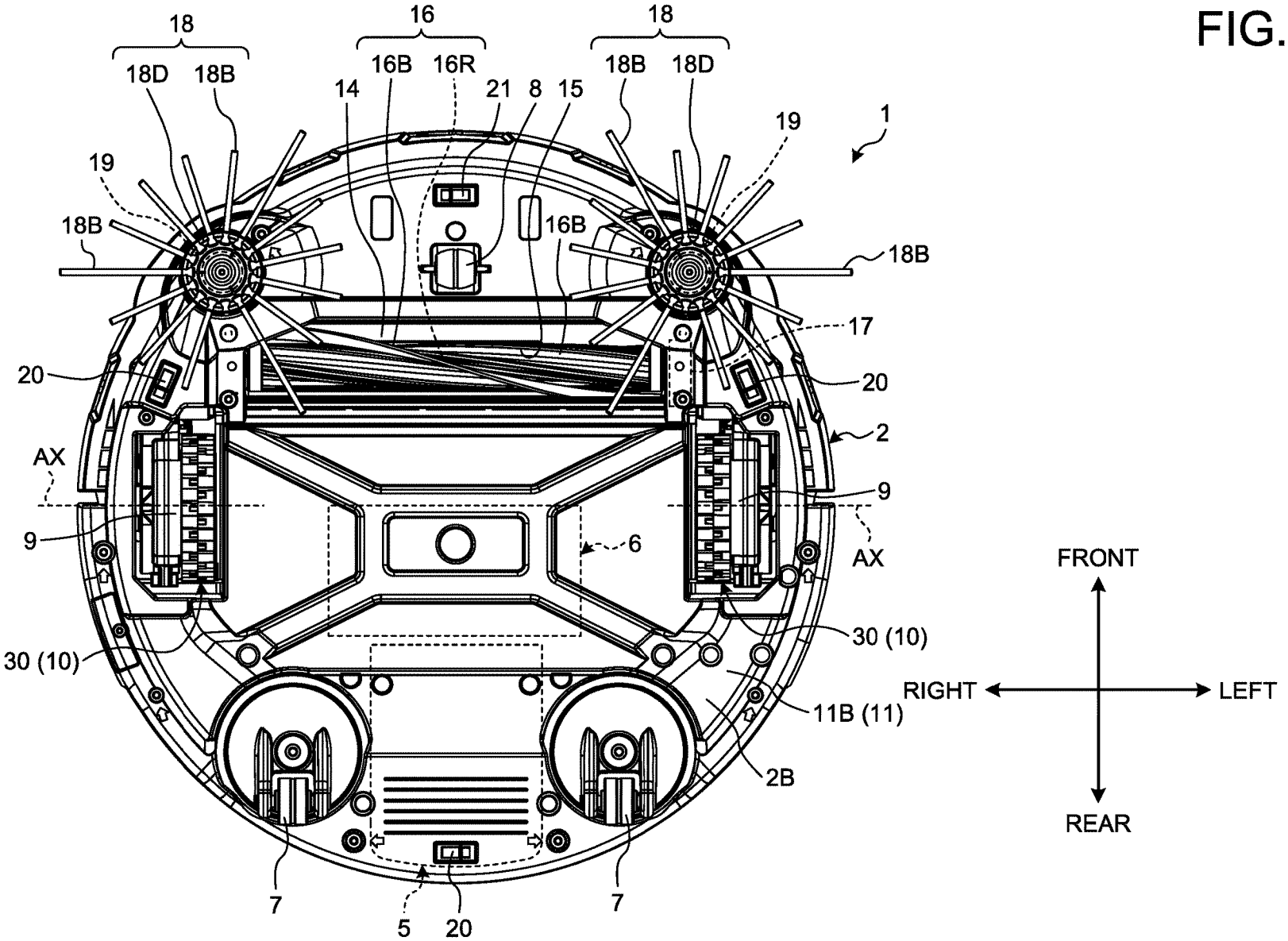
FIG. 2 is a bottom view of the example of the self-propelled device according to the embodiment.

FIG. 1 is a perspective view of an example of a self-propelled device 1 according to an embodiment. FIG. 2 is a bottom view of the example of the self-propelled device according to the embodiment. In the embodiment, positional relations between components will be described using the terms "left", "right", "front", "rear", "up (top)", and "down (bottom)". These terms refer to relative positions or directions based on a center of the self-propelled device 1.

In the embodiment, an example will be described in which the self-propelled device 1 is a robotic dust collector. The robotic dust collector performs cleaning while propelling itself on a cleaning target floor FL serving as a work target surface. In the following description, the self-propelled device 1 is called a robotic dust collector 1.

The robotic dust collector 1 propels itself on a cleaning target floor FL. The robotic dust collector 1 sucks in dust and dirt on the cleating target floor FL while propelling itself. As illustrated in FIG. 1 and FIG. 2, the robotic dust collector 1 includes a body 2, battery mounting units 4 that are provided in the body 2 and have batteries 3 mounted therein; a fan unit 5 that is accommodated in the body 2 and generates a sucking force to suck dust and dirt; a storage unit 6 that is accommodated in the body 2 and stores therein dust and dirt; casters 7 and a roller 8 that are rotatably supported by the body 2; wheels 9 by which the body 2 is movably supported; wheel motors 10 that generate motive power to rotate the wheels 9; and suspension devices 30 by which the wheels 9 are movably supported in the up-and-down direction.

The body 2 has a top face 2A, a bottom face 2B facing the cleaning target floor FL, and side face 2C that connects the edge of the top face 2A and the edge of the bottom face 2B. In a plane parallel to the top face 2A, the body 2 has a substantially circular shape.

The body 2 includes a housing 11 having an internal space. The housing 11 includes an upper housing 11A and a lower housing 11B connected to the upper housing 11A. The top face 2B is arranged in the upper housing 11A. The bottom face 2B is arranged in the lower housing 11B.

The body 2 includes obstacle sensors 12 and a sensor cover 13 that covers at least a part of the obstacle sensors 12. The obstacle sensors 12 are arranged at a front, portion of the side face 2C. A plurality of obstacle sensors 12 are provided so as to be spaced from each other. The obstacle sensors 12 detect an obstacle ahead of the robotic dust collector 1 in a non-contact manner.

The body 2 further includes a bottom plate 14 in which a suction inlet 15 is formed. The suction inlet 15 sucks in dust and dirt on the cleaning target floor FL. The bottom plate 14 is fixed to the lower housing 11B. The suction inlet 15 faces the cleaning target floor FL. The suction inlet 15 is provided in a front portion of the bottom face 2B. The suction inlet 15 has a rectangular shape which is long in the right-and-left direction.

The body 2 further includes a main brush 16 arranged in the suction inlet 15, and a main brush motor 17 that generates motive power to rotate the main brush 16. The main brush 16 faces the cleaning target floor FL. The main brush 16 is long in the right-and-left direction. The main brush 16 includes a rod member 16R extending in the right-and-left direction, and brushes 16B spirally connected to the outer surface of the rod member 16R. The left end portion and the right end portion of the rod member 16R are each rotatably supported by the body 2. The rod member 16R is supported by the body 2 so that at least a part of the brushes 16B protrude downward from the bottom face 2B. The main brush motor 17 is arranged in the internal space of the housing 11. The operation of the main brush motor 17 causes the main brush 16 to rotate.

The body 2 further includes side brushes 18 arranged in the front portion of the bottom face 2B, and side brush motors 19 that generate motive power to rotate the side brushes 18. The side brushes 18 face the cleaning target floor FL. Two side brushes 18 are provided. One of the side brushes 18 is provided to the left of the suction inlet 15. The other side brush 18 is provided to the right of the suction inlet 15. The side brushes 18 each include a disk member 18D and a plurality of brushes 18B radially connected to the disk member 18D. The disk member 18D is rotatably supported by the body 2. The disk member 18D is supported by the body 2 so that at least a part of the brushes 18B protrudes outside the side face 20. The side brush motors 19 are arranged in the internal space of the housing 11. The side brushes 18 rotate by the activation of the side brush motors 19. The side brushes 18 rotate, so that dust and dirt on the cleaning target floor FL are sent to the suction inlet 15.

The body 2 further includes a plurality of fall prevention sensors 20 that detect the presence of the cleaning target floor FL and an infrared sensor 21 that detects a reflective member provided in the cleaning target floor FL. The fall prevention sensors 20 and the infrared sensor 21 are provided on the bottom face 2B. The fall prevention sensors 20 detect, in a non-contact manner, whether the cleaning target floor FL is present at a location facing the bottom face 2B. The fall prevention sensors 20 detect the distance between the bottom face 2B and the cleaning target floor FL. When the bottom face 2B is away from the cleaning target floor FL by a predetermined distance or more, the robotic dust collector 1 determines, based on data detected by the fall prevention sensors 20, that the cleaning target floor FL is not present at a location facing the bottom face 2B. When having determined that the cleaning target floor FL is not present at a location facing the bottom face 2B, the robotic dust collector 1 stops self-propelling. The infrared sensor 21 detects a reflective member provided in the cleaning target floor FL. A cleaning target area is determined by the reflective member. The reflective member is provided on the cleaning target floor FL by a user of the robotic dust collector 1, for example. Based on data detected by the infrared sensor 21, the robotic dust collector 1 propels itself so as not to go beyond the reflective member. This prevents the robotic dust collector 1 from moving to the outside of the cleaning target area, and thus allows the robotic dust collector 1 to clean the cleaning target area.

The body 2 further includes a handle 22 provided in the upper housing 11A. By gripping the handle 22, a user can carry the robotic dust collector 1.

An operating unit 23 to be operated by a user is provided in the rear portion of the upper housing 11A. The operating unit 23 includes a power button 23A, a remaining power indicator 23B for the batteries 3, and an operation-mode select button 23C. For example, a light emitting unit 24 including a light emitting diode is provided in the front portion of the upper housing 11A.

The battery mounting units 4 are provided in the rear portion of the upper housing 11A. Recesses are provided in the rear portion of the upper housing 11A. The battery mounting units 4 are provided inside the respective recesses in the upper housing 11A. Two battery mounting units 4 are provided. One of the battery mounting units 4 is provided to the left of the fan unit 5. The other battery mounting unit 4 is provided to the right of the fan unit 5.

The batteries 3 to be mounted in the battery mounting units 4 include lithium-ion batteries to be used as a power source for electric power tools. The battery mounting units 4 have the same structure as that of a battery mounting unit of an electric power tool. The battery mounting unit 4 includes a guide member that guides the corresponding battery 3 to be mounted, and a terminal connected to a terminal of the battery 3. While being guided by the guide member, the battery 3 is inserted into the corresponding battery mounting unit 4 from above. The battery 3 is mounted in the battery mounting unit 4, so that a terminal of the battery 3 and a terminal of the battery mounting unit 4 are electrically connected to each other. The batteries 3 supply electric power to an electric device or an electronic device mounted in the robotic dust collector 1.

The fan unit 5 is connected to the suction inlet 15 via the storage unit 6 and generates a sucking force to suck in dust and dirt. The fan unit 5 is arranged in the internal space of the housing 11. The body 2 accommodates the fan unit 5. The fan unit 5 is arranged between two battery mounting units 4 in the rear portion of the body 2.

The fan unit 5 includes: a casing arranged in the internal space of the housing 11; a suction fan provided inside the casino; and a suction motor that generates motive power to rotate the suction fan. The casing includes an air inlet port connected to the suction inlet 15 via the storage unit 6, and an air exhaust port that discharges at least a part of gas sucked in by the operation of the suction fan.

The fan unit 5 sucks in dust and dirt on the cleaning target floor FL from the suction inlet 15 via the storage unit 6. The storage unit 6 collects and stores therein dust and dirt sucked in from the suction inlet 15. The storage unit 6 is arranged in the internal space of the housing 11. The body 2 accommodates the storage unit 6. The storage unit 6 is arranged between the suction inlet 15 and the fan unit 5.

The body 2 is movably supported by the casters 7 and the roller 8. The casters 7 and the roller 8 are each rotatably supported by the body 2. Two casters 7 are provided in a rear portion of the bottom face 2B. One of the casters 7 is provided in a left portion of the body 2. The other caster 7 is provided in a right portion of the body 2. One roller 8 is provided in the front portion of the bottom face 2B.

The body 2 is movably supported by the wheels 9. The wheels 9 are rotated by the operation of the wheel motors 10.

By the rotation of the wheels 9, the robotic dust collector 1 propels itself. Two wheels 9 are provided. One of the wheels 9 is provided in the left portion of the body 2. The other wheel 9 is provided in the right portion of the body 2.

The wheel motors 10 generate motive power to rotate the wheels 9. The wheel motors 10 operate by electric power supplied from the batteries 3. The wheel motors 10 are provided in the internal space of the housing 11. Two wheel motors 10 are provided. One of the wheel motors 10 generates motive power to rotate the wheel 9 provided in the left portion of the body 2. The other wheel motor 10 generates motive power to rotate the wheel 9 provided in the right portion of the body 2. The wheels 9 are rotated by the operation of the wheel motors 10. The wheel motors 10 are capable of changing the rotation direction of the wheels 9. When the wheels 9 rotate in one direction, the robotic dust collector 1 moves forward. When the wheels 9 rotate in the opposite direction, the robotic dust collector 1 moves backward. The two wheel motors 10 are capable of operating in the respective different amounts of operation. The two wheel motors 10 operate in the respective different amounts of operation, so that the robotic dust collector 1 turns.

The wheel 9 is movably supported in the up-and-down direction by the suspension device 30. Furthermore, the wheel 9 is rotatably supported about a center axis AX by the suspension device 30. The center axis AX extends in the right-and-left direction.

The suspension device 30 is coupled to the body 2. At least a part of the suspension device 30 is arranged in the internal space of the housing 11. The wheel 9 is supported by the body 2 via the suspension device 30. The suspension device 30 supports the wheel 9 so that at least a part of the wheel 9 protrudes downward from the bottom face 2B. In a state in which the wheels 9 are placed on the cleaning target floor FL, the bottom face 2B of the body 2 faces the cleaning target floor FL with a gap therebetween.

Suspension Device

Figure 3:
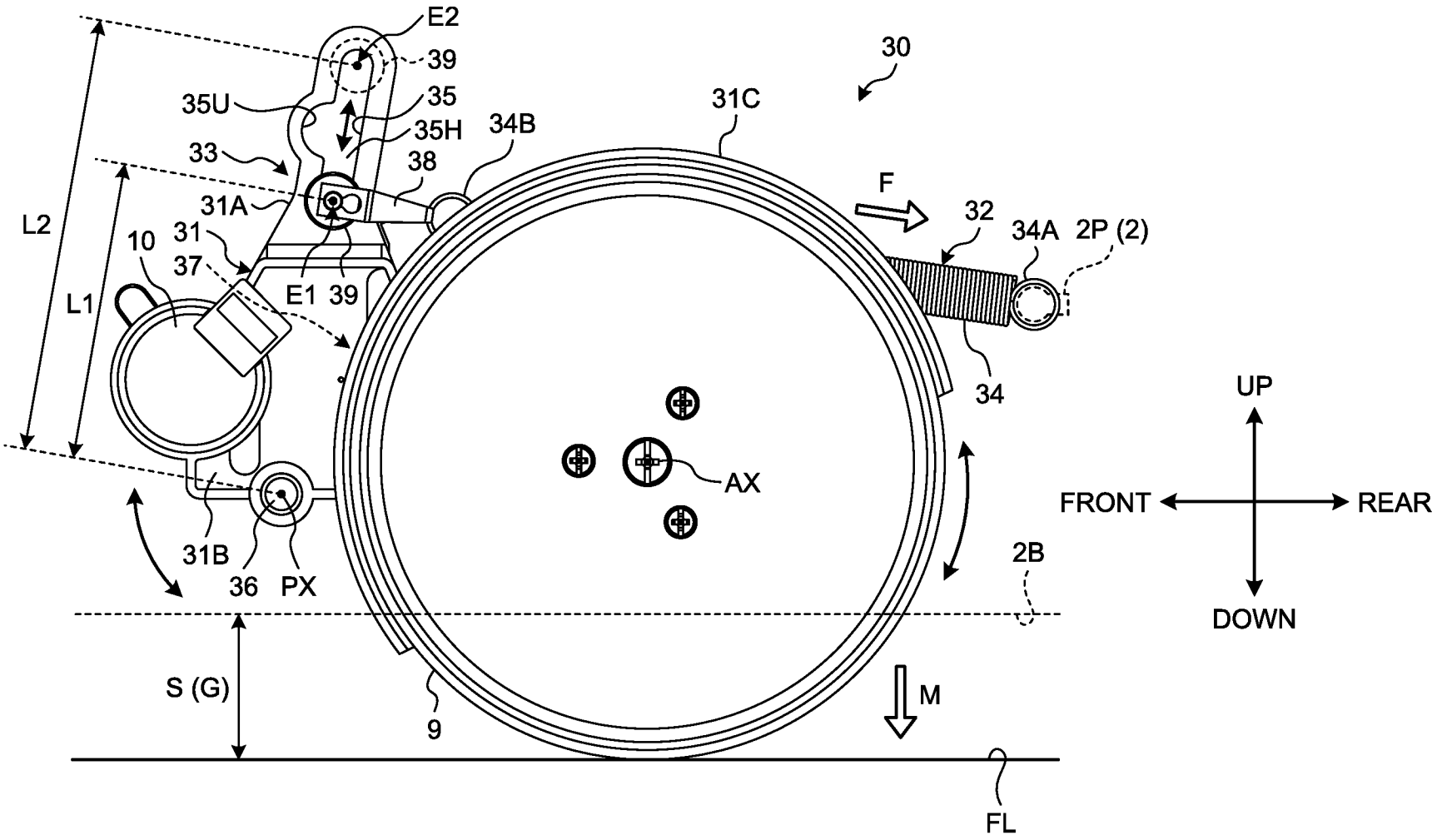
FIG. 3 is a side view of an example of a suspension device according to the embodiment.

FIG. 3 is a diagram illustrating an example of the suspension device 30 that supports the wheel 9 according to the embodiment. As illustrated in FIG. 3, the suspension device 30 includes: a support member 31 by which the wheel 9 is supported rotatably about the center axis AX; a motive-force generating mechanism 32 that gives a motive force F to the support member 31 to generate a biasing force N to cause the wheel 9 to protrude from the bottom face 25 of the body 2; and an adjustment mechanism 33 that adjusts the biasing force N based on the protrusion amount S of the wheel. 9 from the bottom face 2B. The suspension device 30 gives the biasing force N adjusted by the adjustment mechanism 33 to the wheel 9.

In the embodiment, the motive-force generating mechanism 32 includes a spring 34. The spring 34 is a coiled spring. One end portion 34A of the spring 34 is coupled to the body 2. In the example illustrated in FIG. 3, the end portion 34A of the spring 34 is coupled to a hook member 2P provided in the body 2.

The suspension device 30 includes a support unit 36 by which the support member 31 is supported pivotably about a pivot axis PX specified at a position different from that of the center axis AX in a plane perpendicular to the center axis AX. The center axis AX extends in the right-and-left direction. The pivot axis PX is specified to be located ahead of the center axis X. The support unit 36 includes a pin member fixed to the body 2. The support member 31 is supported pivotably about the pivot axis PX by the body 2 via the pin member.

The adjustment mechanism 33 includes a guide 35 by which another end portion 34B of the spring 34 is movably guided. The guide 35 is provided in the support member 31. The support member 31 pivots, so that the other end portion 34B of the spring 34 moves the guide 35.

The support member 31 has a guide hole 35H penetrating in the right-ad-left direction. The guide 35 includes the inner surface of the guide hole 35H. The guide 35 is flat. The guide 35 is substantially elongated in the up-and-down direction.

The other end portion 34B of the spring 34 is coupled to a roller 39 via a coupling member 38. The end portion 34A of the spring 34 is arranged behind the other end portion 34B. The roller 39 is guided by the guide 35. The guide 35 and the roller 39 are relatively movable. The roller 39 is movable so as to slide on the guide 35. The roller 39 is guided by the guide 35, so that the other end portion 34B of the spring 34 is guided by the guide 35.

The roller 39 is arranged in the guide hole 35H. Each of a right end portion and a left end portion of the roller 39 is provided with a flange. Each of the flanges is arranged outside the guide hole 35H, and face the respective side faces of the support member 31. The flanges are in contact with the respective side faces of the support member 31, so that the roller 39 is prevented from coming off the guide hole 35H. A recess 35U is provided in a part of the guide hole 35H. The inner diameter of the recess 35U is larger than the outer diameter of the flanges of the roller 39. On the occasion when the roller 39 is arranged in the guide hole 35H, the roller 39 is arranged in the guide hole 35H via the recess 35U. The coupling member 38 is coupled to each of the right end portion and the left end portion of the roller 39.

While being guided by the guide 35, the roller 39 can move between a lower end portion E1 and an upper end portion E2 of the guide 35. The guide 35 is provided between the lower end portion E1 and the upper end portion E2. When the roller 39 moves between the lower end portion E1 and the upper end portion E2 of the guide 35, the other end portion 34B of the spring 34 moves in the up-and-down direction. The other end portion 34B of the spring 34 moves in the up-and-down direction with respect to the body 2. In contrast, the end portion 34A of the spring 34 is fixed to the body 2. The other end portion 34B of the spring 34 is a moving end that moves in the guide 35, whereas the end portion 34A of the spring 34 is a fixed end.

The wheel motor 10 is supported by the support member 31. The support member 31 includes: a first portion 31A to be provided with the guide 35; a second portion 31B that supports the wheel motor 10; and a third portion 31C arranged in a part of the circumference of the wheel 9. The guide 35 is provided above the pivot axis PX. In the up-and-down direction, the wheel motor 10 is provided between the guide 35 and the pivot axis PX. The wheel motor 10 is arranged ahead of the wheels 9. Motive power generated by the wheel motor 10 is transmitted via a motive-power transmission mechanism 37. The motive-power transmission mechanism 37 includes a plurality of gears to couple an output shaft of the wheel motor 10 to the wheel 9.

The support member 31 is supported pivotably about the pivot axis PX by the body 2. The pivot axis PX is arranged at a lower position than the guide 35. The support member 31 pivots about the pivot axis PX, so that the wheel 9 moves in the up-and-down direction with respect to the body 2. When the wheel 9 moves in the up-and-down direction with respect to the body 2, the protrusion amount S of the wheel 9 from the bottom face 2B varies.

The suspension device 30 supports the wheel 9 such that the wheel 9 moves between a first protrusion position P1 at which the wheel 9 protrudes from the bottom face 2B in a first protrusion amount S1 and a second protrusion position P2 at which the wheel 9 protrudes in a second protrusion amount S2 larger than the first protrusion amount S1. The first protrusion position P1 is a position at which the protrusion amount S of the wheel 9 from the bottom face 23 is the smallest in a movable range of the wheel 9 in the up-and-down direction. The second protrusion position P2 is a position at which the protrusion amount S of the wheel 9 from the bottom face 23 is the largest in the movable range of the wheel 9 in the up-and-down direction.

When the wheel 9 is arranged at the first protrusion position P1 in a state in which the wheel 9 is in contact with the cleaning target floor FL, a distance G between the bottom face 23 and the cleaning target floor FL becomes the shortest. When the wheel 9 is arranged at the second protrusion position P2 in a state in which the wheel 9 is in contact with the cleaning target floor FL, the distance G between the bottom face 2B and the cleaning target floor FL becomes the longest.

When the support member 31 pivots about the pivot axis PX, the roller 39 and the guide 35 relatively move. When the roller 39 and the guide 35 relatively move, the other end portion 34B of the spring 34 coupled to the roller 39 via the coupling member 38 and the guide 35 relatively move. With the movement of the other end portion 34B of the spring 34, a distance L between the other end portion 34B of the spring 34 and the pivot axis PX varies.

In a plane perpendicular to the pivot axis PX, a distance L1 between the pivot axis PX and the lower end portion E1 of the guide 35 is shorter than a distance L2 between the pivot axis PX and the upper end portion E2 of the guide 35. In other words, the distance L2 is longer than the distance L1.

In the following description, the position of the lower end portion E1 may be called a first guide position E1, and the position of the upper end portion E2 may be called a second guide position E2. The other end portion 34B of the spring 34 moves between the first guide position E1 that is apart by the distance F1 (first distance) from the pivot axis PX and the second guide position E2 that is apart by the distance L2 (second distance) longer than the distance L1.

In the embodiment, a motive force F that the motive-force generating mechanism 32 gives to the support member 31 is an elastic force with which the spring 34 pulls the support member 31. The spring 34 generates the elastic force to pull the support member 31 in the direction tangent to a circle around the pivot axis PX. In the following description, the motive force F may be called an elastic force F.

When the other end portion 34B of the spring 34 is arranged at the first guide position E1, the spring 34 generates an elastic force F1. When the other end portion 34B of the spring 34 is arranged at the second guide position E2, the spring 34 generates an elastic force F2. The elastic force F (F1, F2) is proportional to the expansion amount of the spring 34.

In the embodiment, the expansion amount of the spring 34 when the other end portion 34B of the spring 34 is arranged at the first guide position E1 is larger than the expansion amount of the spring 34 when the other end portion 34B of the spring 34 is arranged at the second guide position E2. Alternatively, the expansion amount of the spring 34 when the other end portion 34B of the spring 34 is arranged at the first guide position E1 may be equal to the expansion amount of the spring 34 when the other end portion 34B of the spring 34 is arranged at the second guide position E2.

Figure 4A:
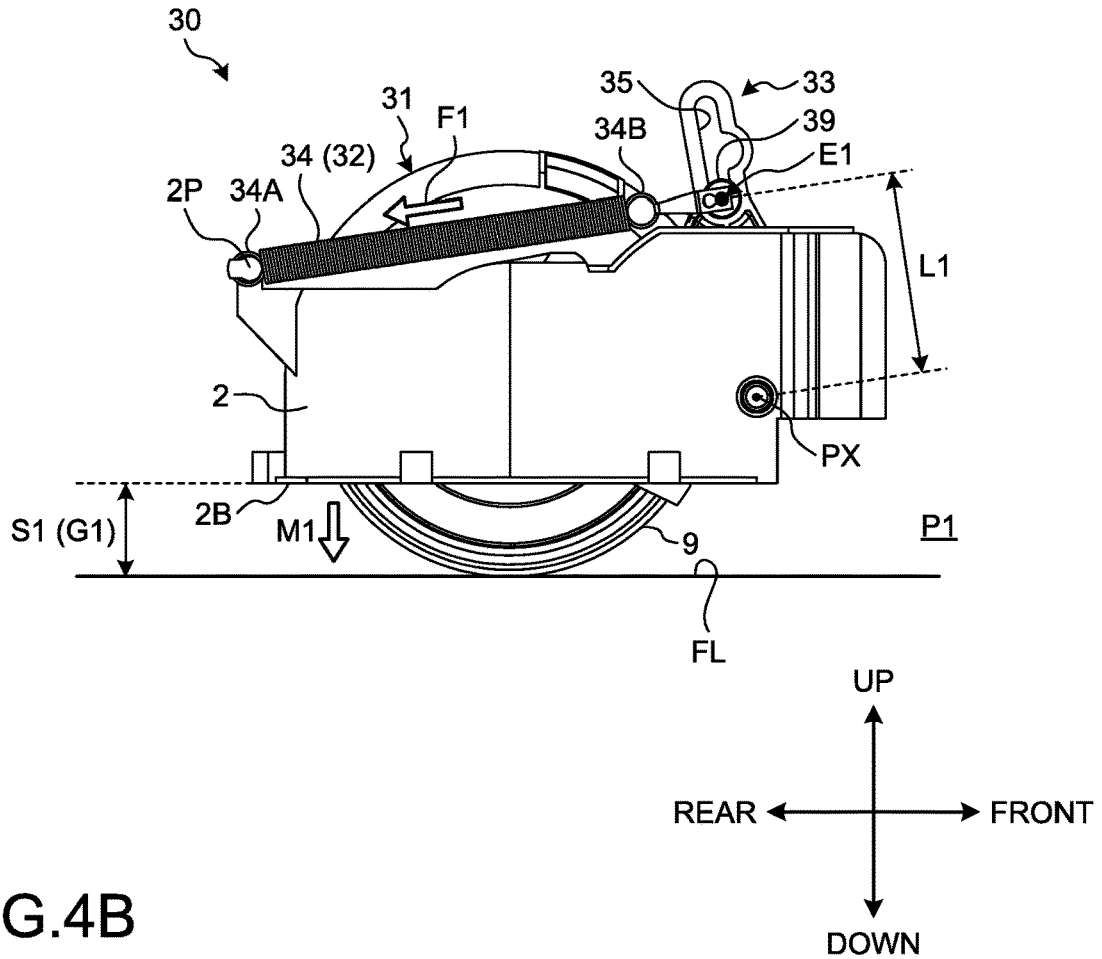
FIGS. 4A and 4B are diagrams illustrating an example of the operation of the suspension device according to the embodiment.
Figure 4B:
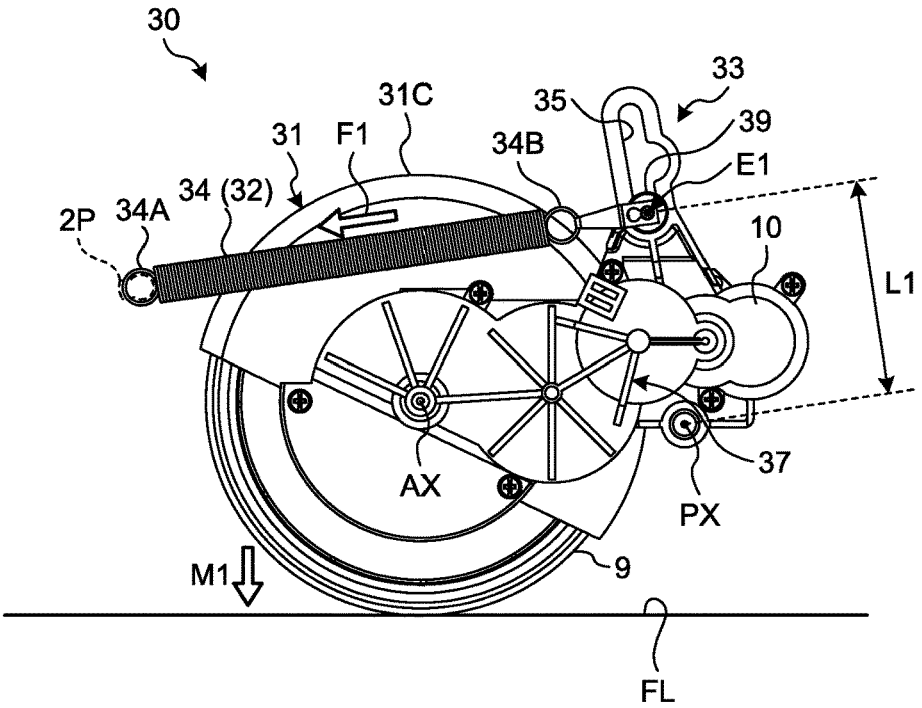
Figure 5A:
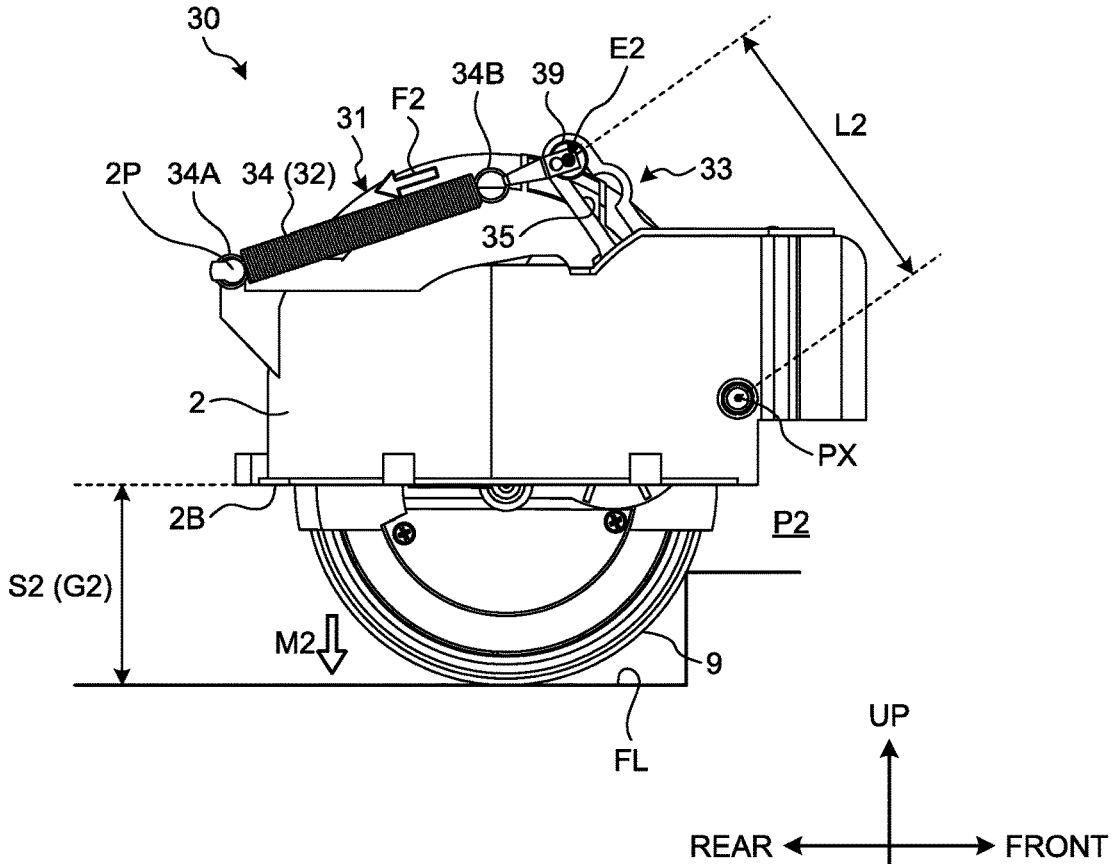
FIGS. 5A and 5B are diagrams illustrating an example of the operation of the suspension device according to the embodiment.
Figure 5B:
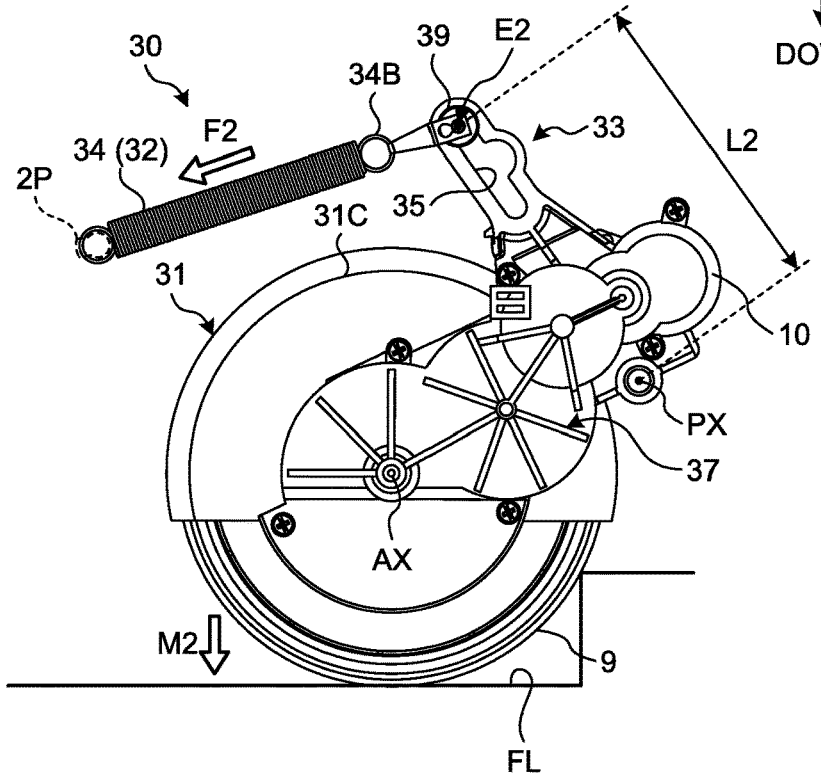

FIGS. 4A, 4B, 5A, and 5B are diagrams each illustrating an example of the operation of the suspension devices 30 according to the embodiment. FIGS. 4A and 4B illustrate a state in which the wheels 9 are arranged at the first protrusion position P1. FIGS. 5A and 5B illustrate a state in which the wheels 9 are arranged at the second protrusion position 92. FIG. 4A and FIG. 5A are diagrams each including the body 2. FIG. 4A and FIG. 5A illustrates a part of the body 2. FIG. 4B and FIG. 5B are diagrams from which the body 2 is removed.

As illustrated in FIGS. 4A and 4B, for example, when the robotic dust collector 1 is to propel itself on a flat cleaning target floor FL, the support member 31 pivots about the pivot axis PX by the weight of the body 2, so that the roller 39 moves to the first guide position E1 of the guide 35. When the roller 39 reaches the first guide position E1, the wheel 9 is arranged at the first protrusion position P1 in the movable range of the wheel 9 in the up-and-down direction. The first protrusion position P1 is a position of the wheel 9 at which the protrusion amount S of the wheel 9 from the bottom face 23 is the smallest.

In contrast, as illustrated in FIGS. 5A and 5B, for example, when the robotic dust collector 1 is running up onto a step of a cleaning target floor F, the support member 31 pivots about the pivot axis PX, so that the roller 39 moves to the second guide position E2. When the roller 39 reaches the second guide position E2, the wheel 9 is arranged at the second protrusion position P2 in the movable range of the wheel 9 in the up-and-down direction. The second protrusion position P2 is a position of the wheel 9 at which the protrusion amount S of the wheel 9 from the bottom face 2B is the largest.

The robotic dust collector 1 causes the wheels 9 to rotate by the operation of the wheel motors 10 in a state in which the wheels 9 are in contact with the cleaning target floor FL, whereby the robotic dust collector 1 propels itself on the cleaning target floor FL. In the case where the robotic dust collector 1 propels itself on a flat cleaning target floor FL; as illustrated in FIGS. 4A and 4B, the wheels 9 are arranged at the first protrusion position P1, the rollers 39 are arranged at the first guide position E1, and the bottom face 2B is apart by a distance G1 from the cleaning target floor FL. In the case where a cleaning target floor FL has a step and the robotic dust collector 1 is running up onto the step; as illustrated in FIGS. 5A and 5B, the wheels 9 are arranged at the second protrusion position P2, the rollers 39 are arranged at the second guide position E2, and the bottom face 2B is apart by a distance G2 from the cleaning target floor FL, the distance G2 being longer than the distance G1. In other words, the body 2 is floated up from the cleaning target floor FL.

The spring 34 gives aft elastic force F to the support member 31 in order to generate a biasing force M to cause the wheel 9 to protrude from the bottom face 2B. The elastic force F is a force to press the wheel 9 against the cleaning target floor FL.

The spring 34 generates an elastic force F so as to pull the support member 31 in the direction tangent to a circle around the pivot axis PX. When the other end portion 34B of the spring 34 is arranged at the first guide position E1, the spring 34 generates an elastic force F1, based on the expansion amount of the spring 34. When the other end portion 34B of the spring 34 is arranged at the second guide position E2, the spring 34 generates an elastic force F2, based on the expansion amount of the spring 34.

The biasing force M to cause the wheel 9 to protrude from the bottom face 2B is specified by the product of the elastic force F of the spring 34 given to the support member 31 and the distance L between the pivot axis PX and a point of action at which the elastic force F of the spring 34 acts on the support member 31. In other words, the biasing force M to cause the wheel 9 to protrude from the bottom face 23 is a moment to cause the support member 31 to pivot about the pivot axis PX, based on the elastic force F of the spring 34. In the embodiment, the point of action at which the elastic force F of the spring 34 acts on the support member 31 is a position of the roller 39.

In the case where the roller 39 is located at the first guide position E1 and the roller 39 is apart by the distance L1 from the pivot axis PX, a biasing force M1 is specified by the product of the distance L1 and the elastic force F1. In the case where the roller 39 is located at the second guide position E2 and the roller 39 is apart by the distance L2 from the pivot axis PX, a biasing force M2 is specified by the product of the distance L2 and the elastic force F2.

In other words, when the robotic dust collector 1 propels itself on a flat cleaning target floor FL, the biasing force M1 is given to the wheel 9. When the robotic dust collector 1 is running up onto a step, the biasing force M2 is given to the wheel 9. As described above, in the embodiment, the biasing force M is adjusted in accordance with a state of the cleaning target floor FL.

Figure 6:
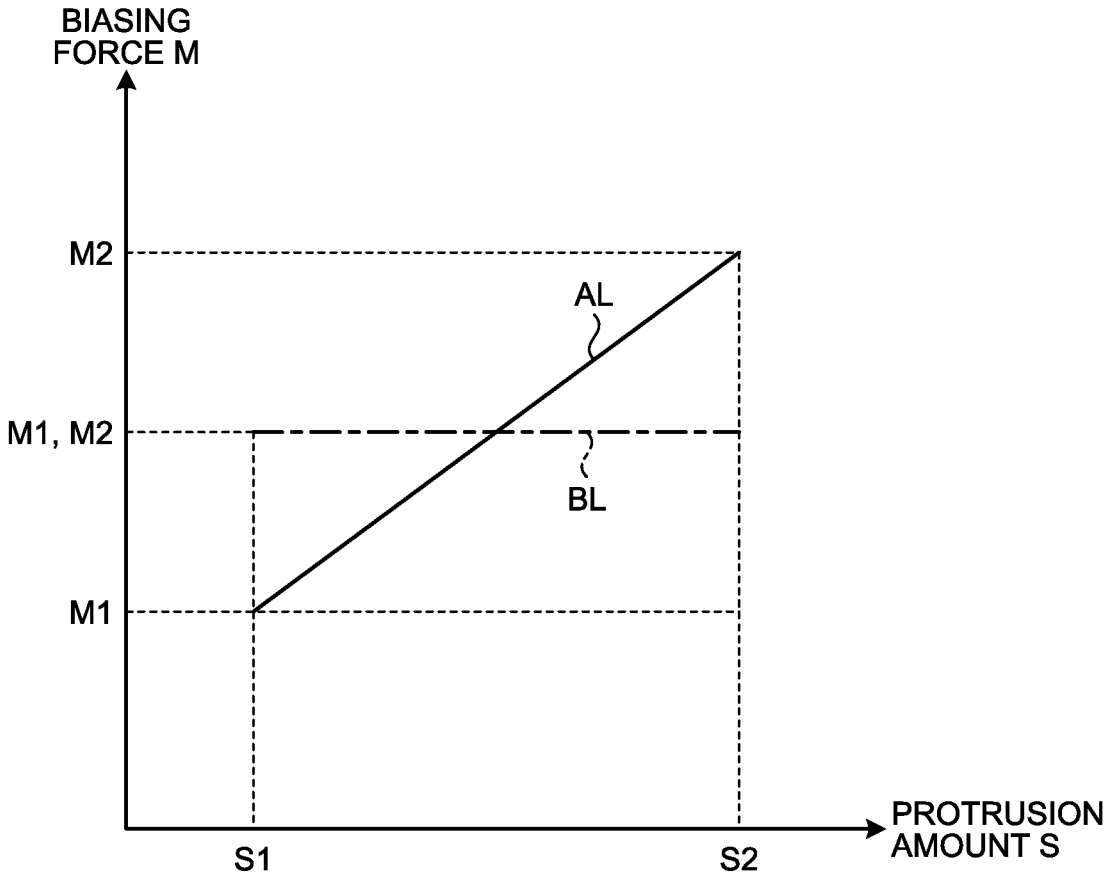
FIG. 6 is a diagram illustrating an example of characteristics of variations in biasing force with respect to a protrusion amount according to the embodiment.

FIG. 6 is a diagram illustrating an example of characteristics of variations in biasing force M with respect to the protrusion amount S according to the embodiment. In a graph in FIG. 6, the horizontal axis indicates the protrusion amount S, and the vertical axis indicates the biasing force M. As indicated with line AL in FIG. 6, in the embodiment, the adjustment mechanism 33 adjusts the biasing force M2 given to the wheels 9 protruding in the second protrusion amount S2 and arranged at the second protrusion position P2 to be larger than the biasing force M1 given to the wheels 9 protruding in the first protrusion amount S1 and arranged at the first protrusion position P1.

When the robotic dust collector 1 propels itself on a flat cleaning target floor FL, a smaller biasing force M1 is given to the wheel 9. As the biasing force M1 is smaller, the distance G1 between the bottom face 2B and the cleaning target floor FL is shorter. This prevents the body 2 from being floated up from the cleaning target floor FL, so that the robotic dust collector 1 can run stably. Furthermore, since the distance between the suction inlet 15 and the cleaning target floor FL is shorter, the main brush 16 and the side brushes 18 can each sufficiently contact the cleaning target floor FL. Thus, the robotic dust collector 1 can clean the cleaning target floor FL satisfactorily.

When the robotic dust collector 1 is running up onto a step of a cleaning target floor FL, a larger biasing force M2 is given to the wheel 9. The biasing force M is a force to press the wheel 9 against the cleaning target floor FL. When a larger biasing force M2 is given to the wheel 9, the wheels 9 can sufficiently grip the cleaning target floor FL. Thus, the wheel 9 can be prevented from slipping.

Effects

As described above, according to the embodiment, the suspension device 30 that supports the wheel 9 include: the support member 31 by which the wheel 9 is supported rotatably about the center axis AX; the motive-force generating mechanism 32 that gives a motive force F (elastic force F) to the support member 31 to generate a biasing force M to cause the wheel 9 to protrude from the bottom face 2B of the body 2; and the adjustment mechanism 33 that adjusts the biasing force M based on the protrusion amount S of the wheel 9 from the bottom face 23. Thus, even when the protrusion amount S of the wheel 9 from the bottom face 23 varies in accordance with a state of the cleaning target floor FL, the biasing force M is adjusted based on the protrusion amount S of the wheel 9 from the bottom face 23, so that the suspension device 30 can give an appropriate biasing force to the wheel 9. In the embodiment, when the robotic dust collector 1 propels itself on a flat cleaning target floor FL, a smaller biasing force M1 is given to the wheel 9. This prevents the body 2 of the robotic dust collector 1 from being floated up from the cleaning target floor FL, so that the robotic dust collector 1 can propel itself stably. When the robotic dust collector 1 is running up onto a step of the cleaning target floor FL, a larger biasing force M2 is given to the wheel 9. This allows the wheel 9 to sufficiently grip the cleaning target floor FL. Thus, the wheel 9 can be prevented from slipping.

In the embodiment, the motive-force generating mechanism 32 includes the spring 34 having one end portion 34A coupled to the body 2 and the other end portion 34B guided by the guide 35. The protrusion amount S of the wheels 9 from the bottom face 2B varies with the pivoting of the support member 31, and the other end portion 34B of the spring 34 moves in the guide 35 with the pivoting of the support member 31. This causes the distance L between the other end portion 34B of the spring 34 and the pivot axis PX to vary. The distance L varies, so that the biasing force M specified by the product of the elastic force F of the spring 34 and the distance L is adjusted.

For example, in the case where the guide 35 is not provided with the support member 31 and the position of the other end portion 34B of the spring 34 is fixed with respect to the support member 31, even when the support member 31 pivots about the pivot axis PX, the distance L between the other end portion 34B of the spring 34 and the pivot axis PX does not vary. In the case where the support member 31 pivots and thereby the wheel 9 is arranged at the second protrusion position P2, the spring 34 is shrunk and the elastic force 12 is reduced accordingly, but the distance L does not become larger. Thus, the biasing force M excessively becomes smaller. As a result, when the robotic dust collector 1 is running up onto a step of the cleaning target floor FL, the wheel 9 cannot sufficiently grip the cleaning target floor FL, and accordingly the wheels 9 is more likely to slip. In the case where a spring 34 having a larger elastic force F is employed, a larger biasing force M is given to the wheel 9, and hence, on the occasion when the robotic dust collector 1 propels itself on a flat cleaning target floor FL, the robotic dust collector 1 propels itself in a state in which the body 2 is floated up from the cleaning target floor FL. In this case, it is difficult for the robotic dust collector 1 to stably propel itself.

In the embodiment, the biasing force M is appropriately adjusted, based on the protrusion amount S of the wheel 9 from the bottom face 23. Therefore, the robotic dust collector 1 can stably propel itself.

Further, in the embodiment, as a power source for the robotic dust collector 1, the batteries 3 for electric power tools are employed. Therefore, it is not necessary to prepare different batteries 3 for different devices used in a working site. This is advantageous in terms of costs and management ease.

Still further, in the embodiment, the other end portion 34B of the spring 34 moves between the first guide position E1 and the second guide position E2. This allows the movable range of the other end portion 34B of the spring 34 to be fixed, and allows an appropriate biasing force M in the movable range of the other end portion 34B to be achieved.

Alternatively, as indicated with line BL in FIG. 6, the adjustment mechanism 33 may adjust the difference between the biasing force M1 given to the wheel 9 protruding in the first protrusion amount S1 and the biasing force M2 given to the wheel 9 protruding in the second protrusion amount S2 to be smaller. In other words, the adjustment mechanism 33 may adjust the biasing force N so that the biasing force M1 is equal to the biasing force M2. As described above, the biasing force N is specified by the product of the elastic force F and the distance L. The distance L1 and the distance L2 may be determined or the elastic force F1 and the elastic force F2, which vary based on the expansion amount of the spring 34, may be determined so that the difference between the biasing force M1 (F1×L1) and the biasing force M2 (F2×L2) becomes smaller. The distance L (L1, L2) and the elastic force F (F1, F2) can be adjusted by, for example, adjusting the structure of the guide 35, such as the inclination angle or length of the guide 35.

In other words, by adjusting, for example, the structure of the guide 35, characteristics of variations in the biasing force M with respect to the protrusion amount S of the wheel 9 from the bottom face 2B can be arbitrarily set. For example, based on the number or the weight of the batteries 3 to be mounted in the robotic dust collector 1, the structure of the guide 35 may be adjusted so as to obtain an appropriate biasing force M.

In the above-described embodiment, the biasing force M is adjusted by the movement of the other end portion 34B of the spring 34 in the guide 35 with the pivoting of the support member 31. Alternatively, the adjustment mechanism 33 may have an actuator, and by the operation of the actuator, the wheel 9 may be given the biasing force M having appropriate variation characteristics with respect to the protrusion amount S of the wheels 9 from the bottom face 2B. For example, an actuator supported by the body 2 may give a motive force to the support member 31. By adjusting a motive force generated by the actuator, characteristics of variations in the biasing force N are adjusted.

In the above-described embodiment, the self-propelled device 1 is a robotic dust collector but is not limited to the robotic dust collector. Examples of the self-propelled device 1 include at least one of a robotic lawn mower, a robotic dirt scraper, and a robotic truck. These self-propelled devices 1 are also capable of performing prescribed work while travelling on a work target surface. The robotic lawn mower performs lawn mowing while propelling itself on lawn serving as a working target surface. The robotic dirt scraper scrapes off dirt while propelling itself on a working target surface. The robotic truck performs materials handling work while propelling itself on a travel surface serving as a working target surface. These self-propelled devices 1 provided with the suspension devices 30 can stably propel themselves on a work target surface.

An aspect of the present invention can provide a robotic dust collector and a self-propelled device that are capable of stably propelling themselves.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A robotic dust collector comprising:

a body that accommodates a storage unit to store therein dust and dirt sucked in from a suction inlet;

a wheel that supports the body;

a wheel motor that generates motive power to rotate the wheel;

a suspension device including a support member by which the wheel is supported rotatably about a center axis, a motive-force generating mechanism that gives a motive force to the support member to generate a biasing force to cause the wheel to protrude from a bottom face of the body, and an adjustment mechanism that adjusts the biasing force based on a protrusion amount of the wheel from the bottom face; and a support unit by which the support member is supported pivotably about a pivot axis specified at a position different from a position of the center axis in a plane perpendicular to the center axis, wherein the suspension device giving the biasing force adjusted by the adjustment mechanism to the wheel, the suspension device supports the wheel such that the protrusion amount of the wheel may vary, the adjustment mechanism is configured to automatically adjust the biasing force applied to the wheel based on changes in the protrusion amount such that an increase in the protrusion amount results in an increase in the biasing force and a decrease in the protrusion amount results in a decrease in the biasing force, the motive-force generating mechanism includes a spring having one end portion coupled to the body, the adjustment mechanism includes a guide provided in the support member and guiding a second end portion of the spring, the protrusion amount varies with pivoting of the support member, and the second end portion of the spring moves in the guide with pivoting of the support member.

2. The robotic dust collector according to claim 1, wherein the movement of the second end portion of the spring causes a distance between the second end portion of the spring and the pivot axis to vary.

3. The robotic dust collector according to claim 1, wherein the second end portion of the spring moves between a first guide position that is apart by a first distance from the pivot axis and a second guide position that is apart by a second distance longer than the first distance.

4. The robotic dust collector according to claim 1, further comprising a battery mounting unit in which a battery for an electric power tool is mounted, wherein the wheel motor operates with electric power supplied from the battery.

5. The robotic dust collector according to claim 1, wherein an end of the motive-force generating mechanism is movably attached to the support member in a direction transverse to a pivot axis of the support member.

6. The robotic dust collector according to claim 1, wherein:

an end of the motive-force generating mechanism is movably attached to the support member at a connection point; and the distance between the connection point and a pivot axis of the support member varies as the protrusion amount varies.

7. A self-propelled device, comprising:

a body;

a wheel that supports the body;

a wheel motor that generates motive power to rotate the wheel;

a support member that supports the wheel and the wheel motor;

a spring having one end coupled to the body and a second end guided by a guide provided in the support member; and a support unit by which the support member is supported pivotably about a pivot axis specified at a position different from a position of a center axis in a plane perpendicular to the center axis, wherein the wheel is supported rotatably about the center axis by the support member, the second end of the spring moves in the guide with pivoting of the support member, and the second end of the spring moves between a first guide position that is apart by a first distance from the pivot axis and a second guide position that is apart by a second distance longer than the first distance.

8. The self-propelled device according to claim 7, wherein the movement of the second end of the spring causes a distance between the second end of the spring and the pivot axis to vary.

9. A robotic dust collector comprising:

a body that accommodates a storage unit to store therein dust and dirt sucked in from a suction inlet;

a wheel that supports the body;

a wheel motor that generates motive power to rotate the wheel;

a suspension device including a support member by which the wheel is supported rotatably about a center axis, a motive-force generating mechanism that gives a motive force to the support member to generate a biasing force to cause the wheel to protrude from a bottom face of the body, and an adjustment mechanism that adjusts the biasing force based on a protrusion amount of the wheel from the bottom face; and a support unit by which the support member is supported pivotably about a pivot axis specified at a position different from a position of the center axis in a plane perpendicular to the center axis, wherein the suspension device provides the biasing force adjusted by the adjustment mechanism to the wheel, the motive-force generating mechanism includes a spring having one end portion coupled to the body, the adjustment mechanism includes a guide provided in the support member and guiding a second end portion of the spring, the protrusion amount varies with pivoting of the support member, the second end portion of the spring moves in the guide with pivoting of the support member, and the second end portion of the spring moves between a first guide position that is apart by a first distance from the pivot axis and a second guide position that is apart by a second distance longer than the first distance.

10. The robotic dust collector according to claim 9, wherein the suspension device supports the wheel such that the wheel moves between a first protrusion position at which the wheel protrudes in a first protrusion amount from the bottom face and a second protrusion position at which the wheel protrudes in a second protrusion amount larger than the first protrusion amount, and the adjustment mechanism adjusts a biasing force given to the wheel protruding in the second protrusion amount to be larger than a biasing force given to the wheel protruding in the first protrusion amount.

11. The robotic dust collector according to claim 9, wherein the suspension device supports the wheel such that the wheel moves between a first protrusion position at which the wheel protrudes in a first protrusion amount from the bottom face and a second protrusion position at which the wheel protrudes in a second protrusion amount larger than the first protrusion amount, and the adjustment mechanism adjusts a difference between a biasing force given to the wheel protruding in the first protrusion amount and a biasing force given to the wheel protruding in the second protrusion amount to be smaller.

12. The robotic dust collector according to claim 9, wherein the movement of the second end portion of the spring causes a distance between the second end portion of the spring and the pivot axis to vary.

13. The robotic dust collector according to claim 9, further comprising a battery mounting unit in which a battery for an electric power tool is mounted, wherein the wheel motor operates with electric power supplied from the battery.

* * * * *